US010233009B2

(12) United States Patent
Ishikawa et al.

(10) Patent No.: US 10,233,009 B2
(45) Date of Patent: Mar. 19, 2019

(54) CONTAINER FOR MICROWAVE OVEN AND PACKAGE FOR MICROWAVE OVEN

(71) Applicant: KYORAKU CO., LTD., Kyoto-shi, Kyoto (JP)

(72) Inventors: Shinji Ishikawa, Tokyo (JP); Tomohiro Yuhara, Tokyo (JP)

(73) Assignee: KYORAKU CO., LTD., Kyoto-shi (JP)

( * ) Notice: Subject to any disclaimer, the term of this patent is extended or adjusted under 35 U.S.C. 154(b) by 0 days.

(21) Appl. No.: 15/122,804

(22) PCT Filed: Dec. 2, 2014

(86) PCT No.: PCT/JP2014/081849
§ 371 (c)(1),
(2) Date: Aug. 31, 2016

(87) PCT Pub. No.: WO2015/145875
PCT Pub. Date: Oct. 1, 2015

(65) Prior Publication Data

US 2017/0073145 A1 Mar. 16, 2017

(30) Foreign Application Priority Data

Mar. 28, 2014 (JP) ..... 2014-070458
Mar. 31, 2014 (JP) ..... 2014-074655

(51) Int. Cl.
*H05B 6/80* (2006.01)
*B65D 81/34* (2006.01)
*B65D 77/20* (2006.01)

(52) U.S. Cl.
CPC ..... *B65D 81/3453* (2013.01); *B65D 77/2036* (2013.01)

(58) Field of Classification Search
CPC ..... B65D 81/34; B65D 81/3453; B65D 81/3461; B65D 77/20; B65D 77/204; B65D 77/2024; B65D 77/2036; B65D 77/225
USPC ..... 219/725, 731, 732, 733, 734, 735; 220/254.1, 359, 359.4, 360, 363, 367.1, 220/373, 657, 659, 804, 202, 203.1, 220/203.16, 203.29, 364, 366
See application file for complete search history.

(56) References Cited

U.S. PATENT DOCUMENTS 4,834,247 A 5/1989 Oshima et al.
2009/0110785 A1* 4/2009 Yasumuro ..... A47J 36/022 426/107

FOREIGN PATENT DOCUMENTS

DE 19860473 A1 6/2000
EP 0398316 A1 11/1990
JP S62-235080 A 10/1987
(Continued)

OTHER PUBLICATIONS

Oct. 4, 2016 International Preliminary Report on Patentability issued in International Patent Application No. PCT/JP2014/081849.
(Continued)

*Primary Examiner* — Hung D Nguyen
(74) *Attorney, Agent, or Firm* — Oliff PLC

(57) ABSTRACT

The objective is to provide a container for microwave oven and a package for microwave oven in which a clearance which is formed between a flanged portion and a lid material and a content may enter is made narrower while maintaining automatic vapor discharge function.

18 Claims, 10 Drawing Sheets

(56) References Cited

FOREIGN PATENT DOCUMENTS

| | | | |
|---|---|---|---|
| JP | H01-69773 | U | 5/1989 |
| JP | H02-84908 | A | 3/1990 |
| JP | H03-667 | A | 1/1991 |
| JP | H10-236542 | A | 9/1998 |
| JP | 2000-153876 | A | 6/2000 |
| JP | 2005-313914 | A | 11/2005 |
| JP | 2006-096367 | A | 4/2006 |
| JP | 2008-290738 | A | 12/2008 |
| JP | 2009-248970 | A | 10/2009 |
| JP | 2010-23851 | A | 2/2010 |

OTHER PUBLICATIONS

Mar. 17, 2015 International Search Report issued in International Patent Application No. PCT/JP2014/081849.
Dec. 5, 2017 Office Action issued in Japanese Patent Application No. 2014-074655.
Dec. 5, 2017 Office Action issued in Japanese Patent Application No. 2014-070458.
Nov. 7, 2017 Search Report issued in European Patent Application No. 14886952.2.
Dec. 5, 2017 Office Action issued in Chinese Patent Application No. 201410330919.7.
Jul. 17, 2018 Office Action issued in Japanese Patent Application No. 2014-074655.

* cited by examiner

CONTAINER FOR MICROWAVE OVEN AND PACKAGE FOR MICROWAVE OVEN

TECHNICAL FIELD

The present invention relates to a container for microwave oven and a package for microwave oven.

BACKGROUND ART

Conventionally, there has been proposed a variety of containers for microwave oven. For example, see Japanese patent publication No. 2008-290738 (A).

Japanese patent publication No. 2008-290738 (A) discloses a cooking container for microwave oven of which a peripheral sealing portion is formed over a whole circumference of a flanged portion of a container body formed of synthetic resin, and a lid material is thermally fused to the peripheral sealing portion. The peripheral sealing portion is provided with a V- or U-shaped projection extending interiorly of the container (i.e., an opening side). In accordance with this conventional cooking container for microwave oven, moisture of the content is heated up in the microwave oven and the inner pressure in the microwave is thus increased. As a result, the lid material is pushed up, and a part of the lid material is automatically removed or separated from the inward projection. For the above reason, a user do not need open the lid material before putting the container in the microwave oven.

On the other hand, this cooking container for microwave oven is provided with an annular portion formed along the inner periphery of the opening of the container in the peripheral sealing portion except for a projection for vapor discharge. The flanged portion is provided with a clearance which is present in a range from the annular portion to the opening, and in which the flanged portion and the lid material are not thermally fused. The content may enter the clearance. In view of the point that the content may compromise the looking or appearance of the flanged portion, the less or narrower clearance is desired. For this reason, the annular portion is preferably located adjacent to the opening of the container.

However, in the cooking container for microwave oven as described in Japanese patent publication No. 2008-290738 (A) the projection for vapor discharge projects or extends from the annular portion toward the opening side in the peripheral sealing portion. Due to this the annular portion is necessarily located away from the opening of the container body in an amount corresponding to a projecting amount of the projection. Accordingly, the annular portion is hardly disposed adjacent to the opening of the container, thereby needing to take measures.

CITATION LIST

Patent Literature

[PLT 1]
Japanese patent publication No. 2008-290738 (A) (in particular, FIG. 7)

SUMMARY OF INVENTION

Technical Problem

The present invention is provided in order to overcome the afore-mentioned drawbacks or problems. The objective of the present invention is to provide a container for microwave oven and a package for microwave oven in which a clearance, which is formed between a flanged portion and a lid material and a content may enter, is made less or narrower while maintaining automatic vapor discharge function.

Solution to Problem

The present invention provides following configurations:

(1) a container for a microwave oven, which has a concave main body configured to receive a content therein and having an opening, an annularly flanged portion formed at the opening in an upper end of the concave main body, and a rib-shaped thermal fusion portion formed over a whole circumference of a top surface of the flanged portion to be thermally fused to a film-shaped lid material for closing the opening. The thermal fusion portion is provided with an opening portion that is approximately V-shaped such that it projects from the opening side toward an outer periphery of the flanged portion in a plan view; a vapor discharge portion that is approximately V-shaped such that it projects from the outer periphery side toward the opening side in a plan view; and an annular portion formed along an annular reference line, which is similar to a shape of an inner periphery of the opening, except for the opening portion and the vapor discharge portion. In this configuration, a pair of end portions of the vapor discharge portion located at the outer periphery side is located closer to the outer periphery than the reference line in a cross-and-width direction of the flanged portion, and connected through a pair of inclined portions to an end portion of the annular portion located at both sides of the vapor discharged portion. The annular portion is disposed at location less than 50% of a width of the flanged portion from the opening.

(2) In the container for the microwave oven according to (1), the vapor discharge portion at the pair of end portions is disposed at location of 50% or above of the width of the flanged portion from the opening.

(3) In the container for the microwave oven according to (1) or (2), the vapor discharge portion at the end portion located at the opening side is disposed at location which the reference line passes.

(4) In the container for the microwave oven according to any of (1)-(3), the annular portion lies between the opening portion and the vapor discharge portion.

(5) In the container for the microwave oven according to any of claims 1)-(4), each of the pair of the inclined portions together with a part of the vapor discharge portion forms an approximately V-shape, and the opening portion is formed adjacent to both sides of the vapor discharge portion.

(6) In the container for the microwave oven according to any of (1)-(5), the flanged portion has a first enlarged portion and a second enlarged portion which is wider than the first enlarged portion, and the opening portion is formed in the second enlarged portion.

(7) In the container for the microwave oven according to (6), the main body has an approximately circular or oval shape at the opening, and the second enlarged portion is formed as a grasping portion.

(8) In the container for the microwave oven according to (6), the main body has an approximately rectangular shape at the opening, and the second enlarged portion is formed as a corner portion.

(9) In the container for the microwave oven according to any of (1)-(8), the annular portion is located close to the opening.

(10) In the container for the microwave oven according to any of (1)-(9), the main body has a plurality of receiving portions configured to receive the content therein, and a plurality of the vapor discharge portions is formed corresponding to the plurality of receiving portions.

(11) a package for a microwave oven by which a content is hermetically sealed and stored, provided with a film-shaped lid material, and the container for the microwave oven according to any of (1)-(10) hermetically sealed by the film-shaped lid material.

Advantageous Effects of Invention

According to the present invention, a container for microwave oven and a package for microwave oven in which a clearance which is formed between a flanged portion and a lid material and a content may enter is made less or narrower while maintaining automatic vapor discharge function when the content is heated in a microwave oven.

BRIEF DESCRIPTION OF DRAWINGS

FIG. 9(*a*) is a plan view of a container for microwave oven and FIG. 9(*b*) is an enlarged view of section P of FIG. 9(*a*).

DESCRIPTION OF EMBODIMENTS

Figure 1:
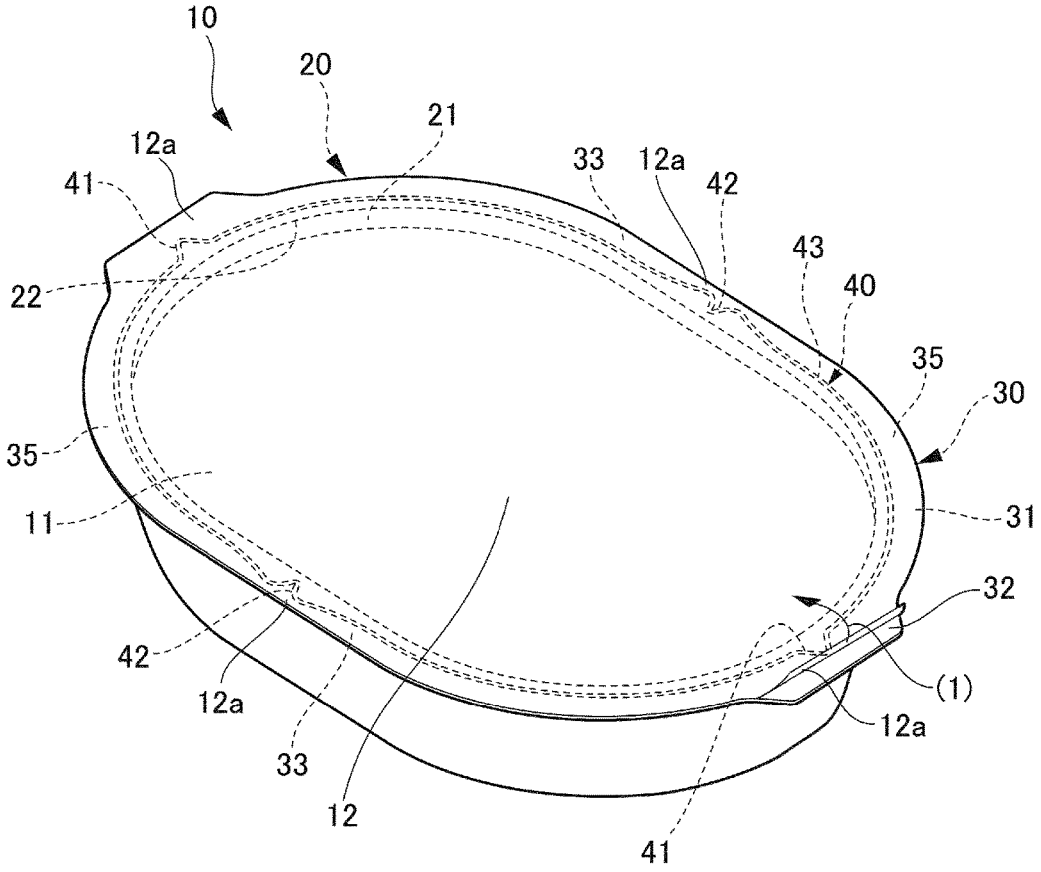
FIG. 1 is a perspective view of one embodiment (a first embodiment) of a package for microwave oven in accordance with the present invention.

Referring to the accompanying drawings, one embodiment of the present invention will be hereinafter described in detail. Furthermore, the same reference numeral is assigned to the same element or part throughout the overall specification.

A First Embodiment

An overall configuration of a package for microwave oven 10 will be described with reference to FIG. 1. As shown in FIG. 1, a first embodiment of a package for microwave oven 10, which may be hereinafter referred to as "package 10", is configured to store or preserve a content 11 hermetically sealed therein. The package 10 is provided with a container for microwave oven 20, which may be hereinafter referred to as "container 20", and a film-shaped lid material 12 for closing an opening 22 of the container 20 to seal the container 20.

The content 11 may be any type of food which can be heated in a microwave oven.

(Configuration of Lid Material 12)

Figure 2:
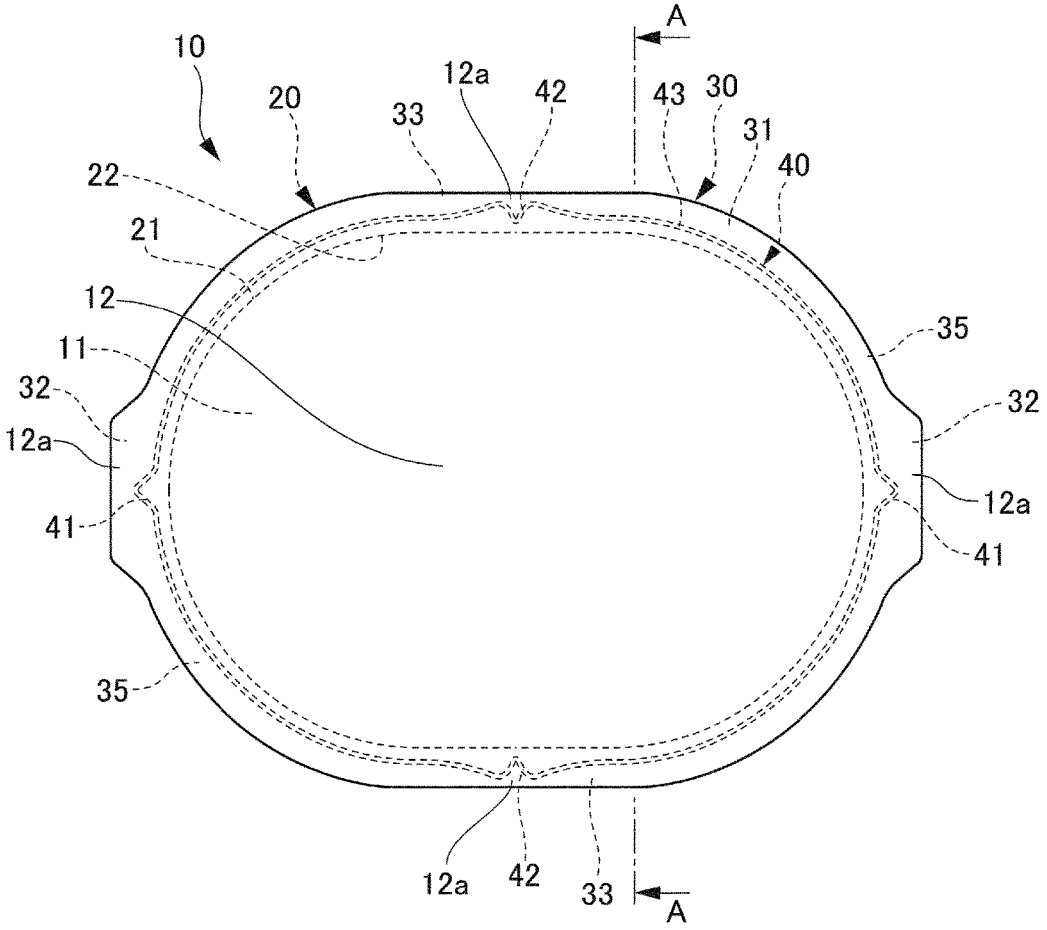
FIG. 2 is a plan view of the package for the package for microwave oven of FIG. 1.

Next, the configuration of the lid material 12 will be described. As shown in FIG. 2, the appearance or contour of the lid material 12 corresponds to the appearance or contour of the container 20. The lid material 12 may be formed of a single layer or multiple layers. At least back face of the lid material 12 may be formed of synthetic resin which can be thermally fused to a thermal fusion portion 40 of the container 20. The thermal fusion portion 40 will be described below. Such synthetic resin may include polyolefin which is represented by polyethylene.

(Configuration of Container 20)

Figure 3A:
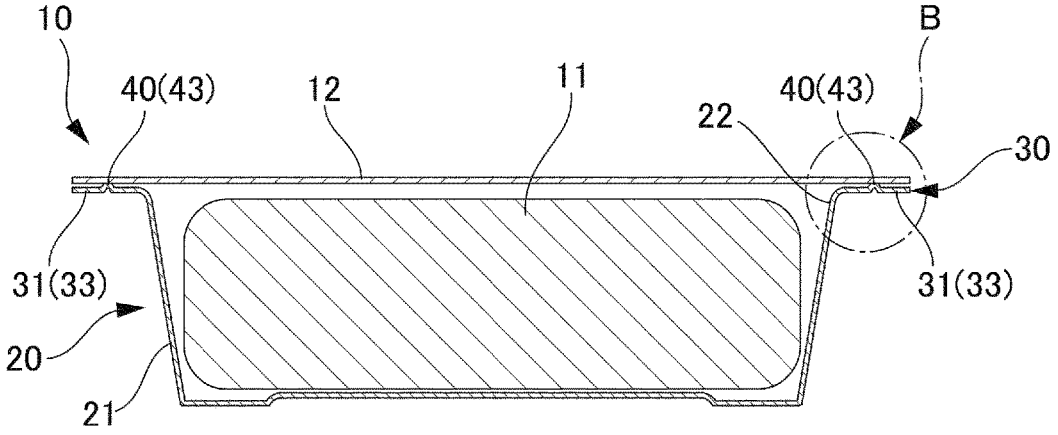
FIG. 3(*a*) is a cross-sectional view of FIG. 2 along the line A-A, and FIG. 3(*b*) is an enlarged view of section B of FIG. 3(*a*).
Figure 3B:
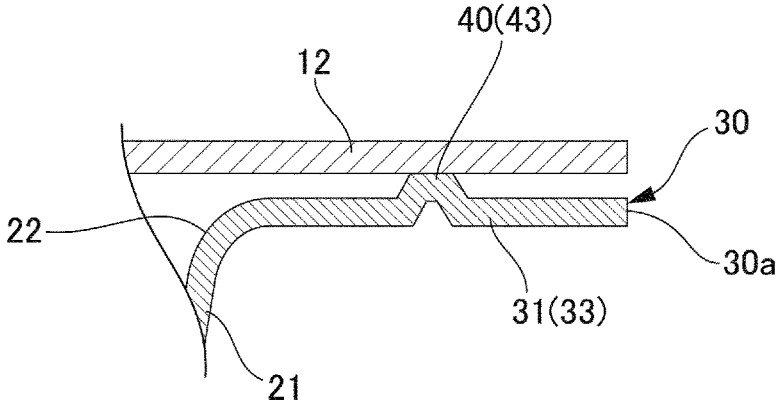

Next, the configuration of the container 20 will be described with reference to FIGS. 3-5. Referring to FIG. 3(*a*), the container 20 is provided with a tray-shaped concave main body 21 being capable of receiving the content 11 therein, and an annularly flanged portion 30 formed in the opening 22 at the upper end of the main body 21.

Figure 4:
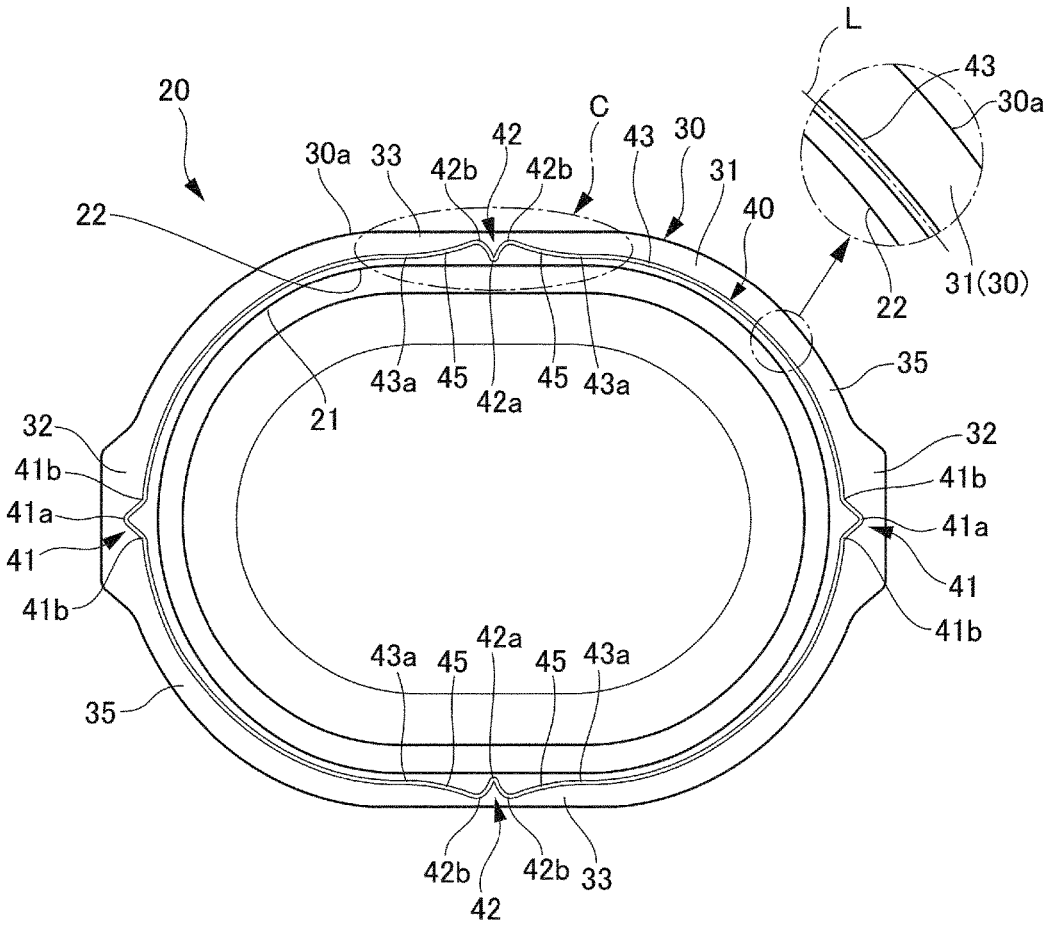
FIG. 4 is a plan view of a container for microwave oven as shown in FIG. 2.

Referring to FIG. 4, the main body 21 has an approximately oval-shaped appearance in the plan view. The appearance (i.e., shape) of the main body as defined by the present invention is not limited to this embodiment, and may be selected from a variety of appearances (i.e., shapes) including an approximately rectangular shape, an approximately polygonal shape, and an approximately circular shape, in addition to the above approximately oval shape.

The flanged portion 30 is provided with an annular base portion 31 formed along an inner peripheral shape of the opening 22 and having an approximately constant width, and a pair of grasping portion 32 extending exteriorly of the base portion 31 and having an enlarged width. The base portion 31 may be referred to as a "first enlarged portion" and the grasping portion 32 may be referred to as a "second enlarged portion". The base portion 31 has a pair of linear portions 33 opposed to each other via a center of the main body 21, and a pair of arc-shaped portions 35 opposed to each other in a direction perpendicular to the direction in which the pair of linear portions 33 are opposed to each other. Each of the pair of grasping portions 32 is formed at a side end or side edge of the arc-shaped portion 35. The base portion 31 of the flanged portion 30 is provided with a thermal fusion portion 40, which is formed over the whole circumference of the top surface of the base portion 31.

Returning to FIG. 3(*b*), the thermal fusion portion 40 is rib-shaped such that it upwardly extends from the top surface of the base portion 31. At least the thermal fusion portion 40 of the container 20 is formed of synthetic resin, which can be thermally fused to the back face of the lid material 12 and may be polyolefin-based resin represented by polyethylene. The lid material 12 is thermally fused to the thermal fusion portion 40.

More specifically, contact surfaces of the lid material 12 and the thermal fusion portion 40 are thermally fused to each other by downward pressing a heated metallic sealing bar against the lid material 12 disposed on the thermal fusion portion 40. The strength or intensity of thermal fusion on the contact surfaces depends on a temperature of the sealing bar, a period of time pressing and contacting the sealing bar, a material for the thermal fusion portion 40 and a material for the lid material 12. The strength or intensity of thermal fusion can be suitably controlled in conformity with the sealing strength or intensity required for the package 10.

On the other hand, easy peeling properties are also required for the package 10. In order to obtain easy peeling properties, it is advantageous to form a portion not to be thermally fused on the contact surface of the lid material 12 and the thermal fusion portion 40. For example, the back face of the lid material 12 may be formed of low-density polyethylene, and the thermal fusion portion 40 may be formed of a mixed or blended material of low-density polyethylene and the polypropylene. Due to this, there is provided a portion to be thermally fused and a portion not to be thermally fused on the contact surface of the lid material 12 and the thermal fusion portion 40.

As shown in FIG. 4, the thermal fusion portion 40 is provided with a pair of opening portions 41 and a pair of vapor discharge portions 42. Each opening portion 41 is formed in the center of each arc-shaped portion 35. Each vapor discharge portion 42 is formed in the center of each linear portion 33. Furthermore, the portion of the thermal fusion portion 40 except for the opening portion 41 and the vapor discharge portion 42 is provided with an annular portion 43. Due to this, on the annular portion 43 the opening portion 41 is spaced from the vapor discharge portion 42 and the annular portion 43 lies between the opening portion 41 and the vapor discharge portion 42.

Each of the opening portion 41 is V-shaped such that it projects from the opening 22 side toward the outer periphery 30*a* of the flanged portion 30.

The opening portion 41 as thus obtained has a function to easily separate or remove the lid material 12 when the package 10 having been heated in the microwave oven and taken from the microwave oven is intended to be opened. In other words, when an edge portion 12*a* (see FIG. 1) of the lid material 12 is grasped and lifted by a hand in the grasping portion 32 (see FIG. 1, arrow (1)), stress is centered on an end portion 41*a* of the opening portion 41 at the outer periphery 30*a* side, thereby allowing the lid material 12 to be easily removed or separated from the opening portion 41 beginning at the end portion 41*a* of the opening portion 41 located adjacent to the outer periphery 30*a* (i.e., at the outer periphery 30*a* side) toward the pair of the end portions 41*b* of the opening portion 41 located adjacent to the opening 22 (i.e., at the opening 22 side).

Figure 5A:
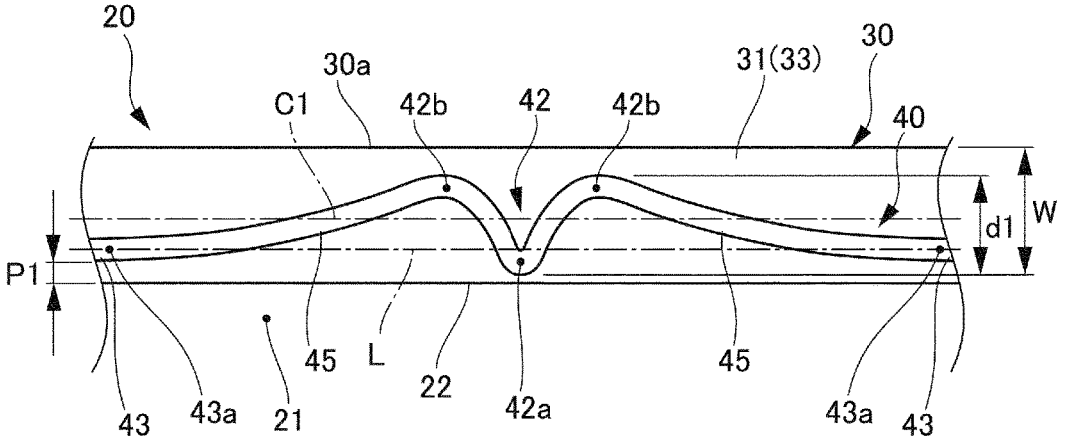
FIG. 5(*a*) is an enlarged view of section C of FIG. 4, and FIG. 5(*b*) shows a comparative example of FIG. 5(*a*).
Figure 5B:
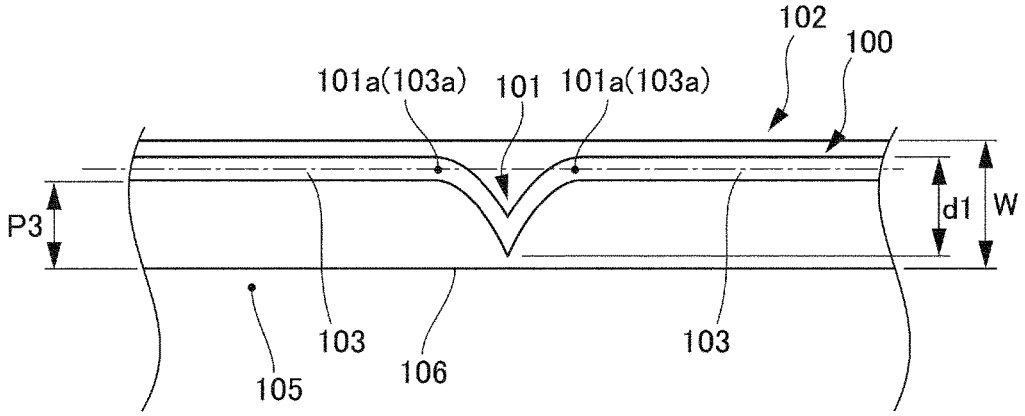

Referring to FIG. 5(*a*), the annular portion 43 is formed along a reference line L having an annular shape which is similar to that of the inner periphery of the opening 22. Furthermore, the annular portion 43 is disposed at a location less than 50% of a width W of the flanged portion 30 (i.e., a width of the flanged portion 30 in a direction perpendicular to the tangent line of the opening 22) from the opening 22. In other words, the annular portion 43 is located closer to the opening 22 than a center C1 of the flanged portion 30 in the across-the-width direction. The annular portion 43 may be preferably disposed at a location less than 15% of the width W of the flanged portion 30 from the opening 22, and may be more preferably disposed at a boundary area (0%) between the opening 22 and the flanged portion 30. In a case where the annular portion 43 is disposed at a location less than 50% of the width W of the flanged portion 30 from the opening 22, when, due to vapor created after heating in the microwave oven, an inner pressure of the container 20 is increased to expand or inflate the lid material 12, the annular portion 43 is made close to the opening 22 at the fused portion between the lid material 12 and the flanged portion 30. Due to this, the clearance between the flanged portion 30 and the lid material 12 is made shallow, thereby preventing the vapor from entering the clearance. As a result, as stress for separating or removing the lid material 12 from the flanged portion 30 is centered on a front end portion of the approximately V-shaped vapor discharge portion 42 (i.e., the end portion 42*a* at the opening 22 side), the lid material 12 preferentially peels in the vapor discharge portion 42, thereby allowing the vapor to be discharged outside. Furthermore, while the annular portion 43 (i.e., the reference line L) may be preferably disposed at a position less than 50% of the width W, more preferably, less than 15% of the width W, most preferably the boundary area (0%) between the opening 22 and the flanged portion 30 over the whole position (i.e., whole length) of the flanged portion 30, it may be disposed at a position preferably less than 50% of the width W, more preferably, less than 15% of the width W, and most preferably the boundary area (0%) between the opening 22 and the flanged portion 30 over the position of at least 80% of the whole length of the annular portion 43. Furthermore, the width W of the flanged portion 30 may be in the range of from 5 mm to 16 m, and the distance from the opening 22 to the annular portion 43 in the flanged portion 30 may be in the range of from 0 to 8 mm, preferably from 0 to 2.4 mm.

The vapor discharge portion 42 is approximately V-shaped such that it projects from the outer periphery 30*a* side toward the opening 22 side in the plan view. Furthermore, the end portion 42*a* of the vapor discharge portion 42 at the opening 22 side is located slightly closer to the opening 22 than the reference line L in the across-the-width direction of the flanged portion 30.

On the other hand, a pair of end portions 42*b* of the vapor discharge portion 42 at the outer periphery 30*a* side is located closer to the outer periphery 30*a* than the reference line L in the across-the-width direction of the flanged portion 30. In this embodiment, the pair of end portions 42*b* at the outer periphery 30*a* side is located in a position of 50% or above of the width W of the flanged portion 30 from the opening 22. In other words, the pair of end portions 42*b* at the outer periphery 30*a* side is located closer to the outer periphery 30*a* than the center C1 in the cross-the-width direction of the flanged portion 30. The pair of the end portions 42*b* at the outer periphery 30*a* side is connected to two end portions 43*a* of the annular portion 43 disposed at both sides of the vapor discharge portion 42 through a pair of inclined portions 45.

While in this embodiment the vapor discharge portion 42 and the inflection portion 45 (or inclined portion) are curved, the vapor discharge portion 42 and the inflection portion 45 may be approximately linear. Furthermore, an opening angle of the end portion 42*a* of the vapor discharge portion 42, an angle between the vapor discharge portion 42 and the inflection portion 45, and an angle between the annular portion 43 and the inflection portion 45 may be arbitrarily determined.

In such a vapor discharge portion 42, the moisture of the content 11 (see FIG. 1) is heated in the microwave oven, and the inner pressure accordingly increases. When the lid material 12 (see FIG. 1) is lifted or pushed up due to the increased inner pressure, the edge 12*a* (see FIG. 1) of the lid material 12 lifted or pushed up automatically peels or removes. In other words, when the lid material 12 (see FIG. 1) is pushed up, stress is centered on the end portion 42*a* of the vapor discharge portion 42 located at the opening 22 side. As a result, the edge 12*a* (see FIG. 1) of the lid material 12 automatically removes or peels from the end portion 42*a* of the vapor discharge portion 42 at the opening 22 side. Accordingly, sealing properties is loss, and the vapor is discharged through the vapor discharge portion 42. Furthermore, a depth d1 of the vapor discharge portion 42 can be appropriately determined depending on the vapor discharge function as required.

Effect of the Embodiment

In the embodiment, the pair of end portions 42*b* of the vapor discharge portion 42 at the outer periphery 30*a* side is located closer to the outer periphery 30*a* than the reference line L. Furthermore, the pair of end portions 42*b* of the vapor discharge portion 42 at the outer periphery 30*a* side is connected to the end portion 43*a* of the annular portion 43 through the pair of inflection portions 45. Inflection points, at or near the end portions 43*a*, correspond to points where the inflection portions 45 begin to divert, bend, or inflect from the regular path of the annular portion 43. Due to this, while securing the necessary depth d1 of the vapor discharge portion 42, the annular portion 43 can be disposed such that it approximates the opening 22 of the main body 21.

A case where the pair of end portions of the vapor discharge portion is directly connected to the pair of end portions of the annular portion is hereinafter considered.

FIG. 5(*b*) shows a comparative examples of the thermal fusion portion 40 as shown in FIG. 5(*a*). Referring to FIG. 5(*b*), in a thermal fusion portion 100 as shown in this comparative example a pair of end portions 101*a* of a vapor discharge portion 101 is located in substantially same position as an annular portion 103 in across-the-width direction of a flanged portion 102. In other words, a pair of the end portions 101*a* of the vapor discharge portion 101 is directly connected to a pair of end portions 103*a* of the annular portion 103 without the inclined portion. In such a thermal fusion portion 100, the annular portion 103 is necessarily located away from an opening 106 of the main body 105 in an amount corresponding to the depth d1 of the vapor discharge portion 101. Accordingly, the distance P3 from the opening 106 to the annular portion 103 increases, thereby increasing or widening the clearance, where the content may enter, on a top surface (i.e., an upper surface) of the flanged portion 102.

In this regard, in the thermal fusion portion 40 as shown in FIG. 5(*a*), the annular portion 43 approximates the opening 22 of the main body 21, thereby decreasing the distance P1 from the opening 22 to the annular portion 43. Accordingly, in accordance with this embodiment of the present invention, while keeping automatic vapor discharge function of the vapor discharge portion 42, the clearance where the content 11 may enter can be made narrow on the top surface of the flanged portion 30.

(Modified Thermal Fusion Portion)

Figure 6:
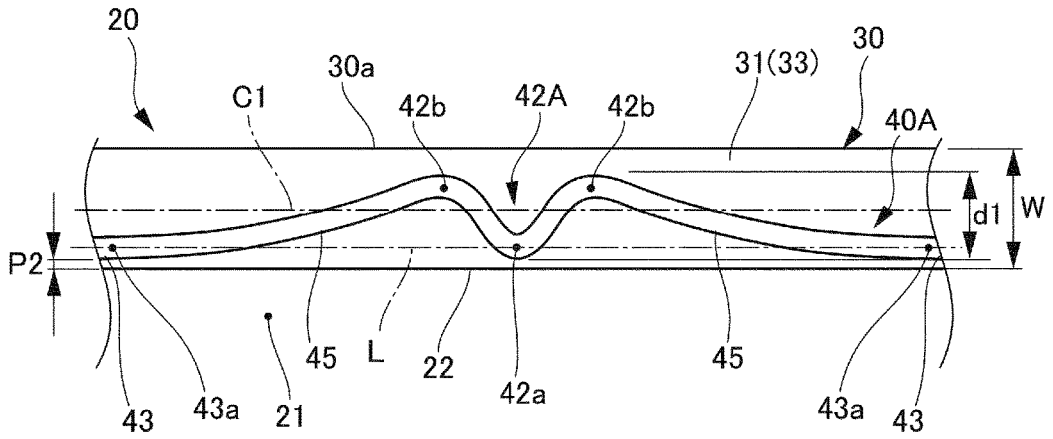
FIG. 6 is an illustrative view of a thermal fusion portion of one modified embodiment, and corresponds to FIG. 5(*a*).
Figure 7:
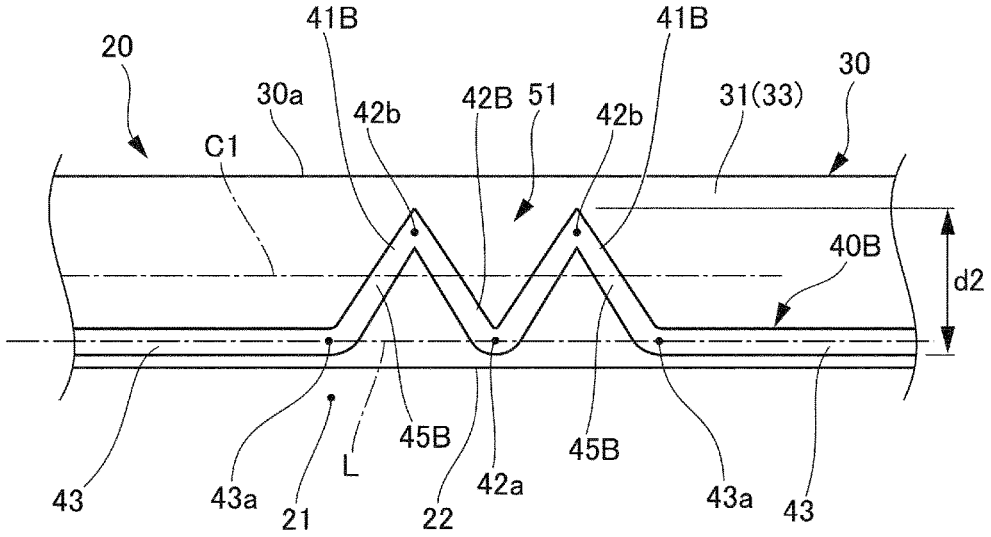
FIG. 7 is an illustrative view of a thermal fusion portion of another modified embodiment and corresponds to FIG. 5(*a*).
Figure 8:
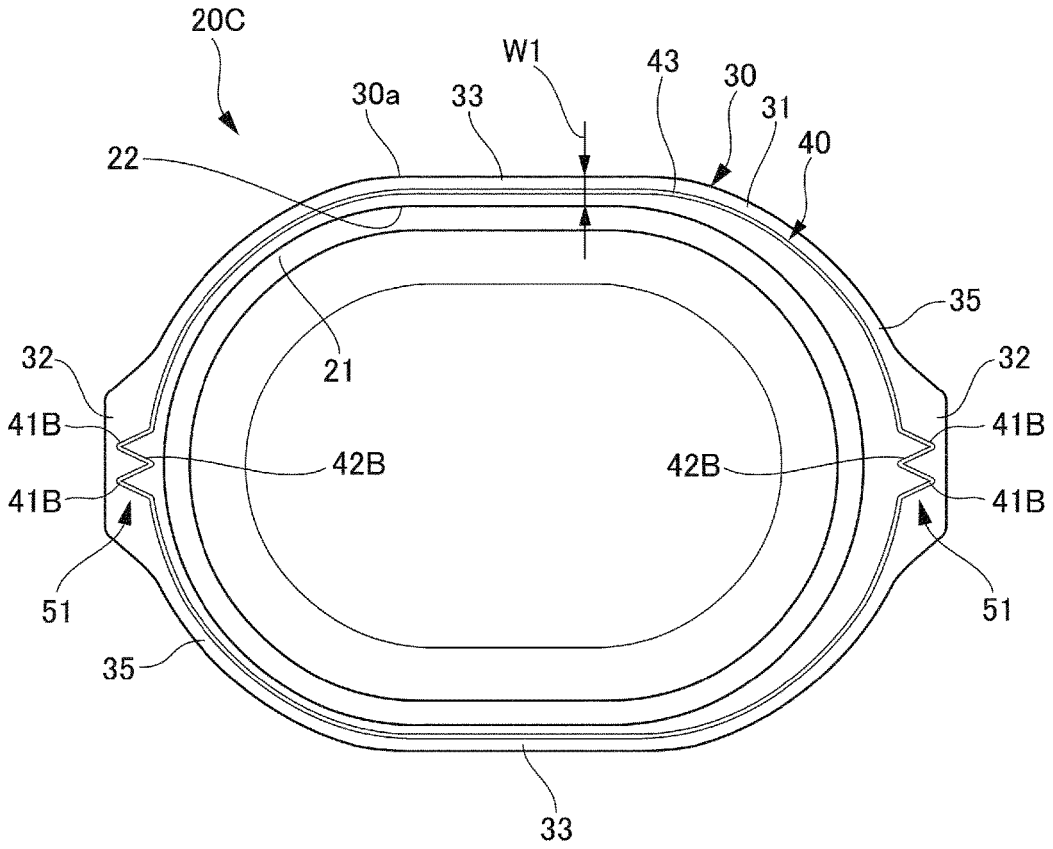
FIG. 8 is an illustrative view of application or use of the heat sealing portion of another modified embodiment, and corresponds to a plan view of a container for microwave oven.
Figure 9A:
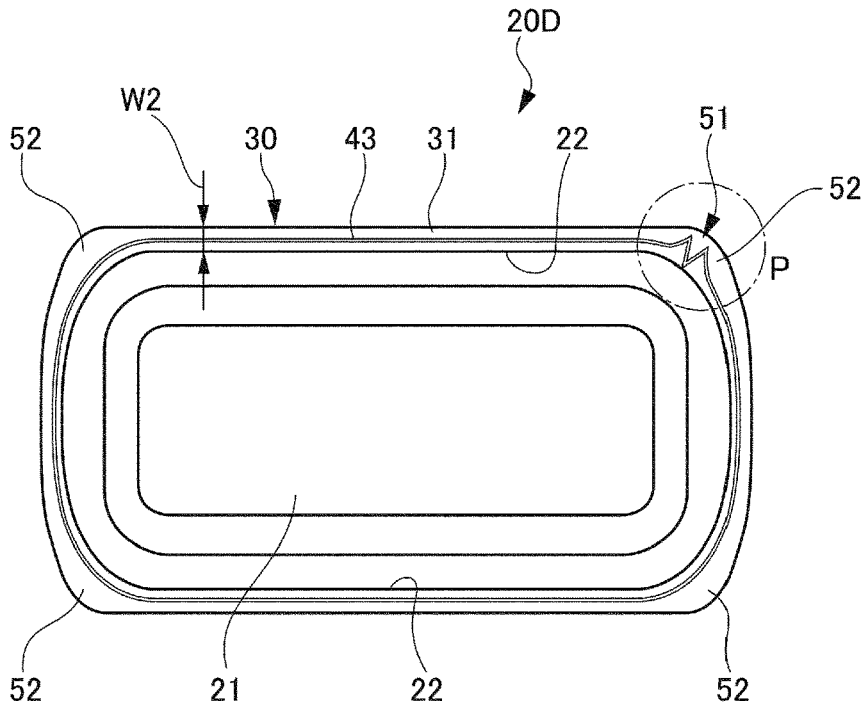
FIG. 9 is an illustrative view of other application or use of the heat sealing portion of another modified embodiment.
Figure 9B:
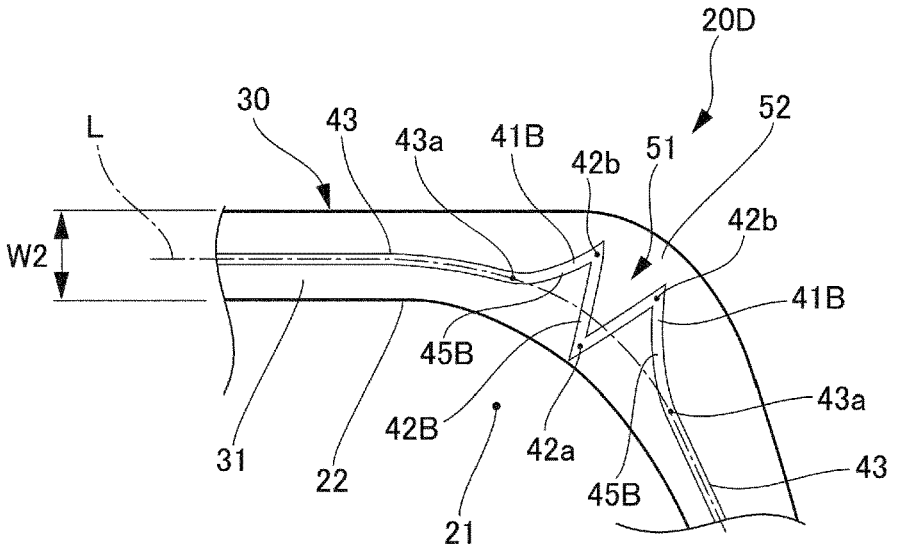

Another embodiment where the thermal fusion portion is modified will be thereinafter described with reference to FIGS. 6-9. FIG. 6 is an illustrative view of a heat sealing portion of one modified embodiment (i.e., a first modified embodiment), and corresponds to FIG. 5(*a*). FIG. 7 is an illustrative view of a heat sealing portion of another modified embodiment (i.e., a second modified embodiment) and corresponds to FIG. 5(*a*). FIG. 8 is an illustrative view of application or use of a heat sealing portion of another modified embodiment (i.e., the second modified embodiment) and corresponds to a plan view of a container for microwave oven. FIG. 9 is an illustrative view of other application or use of a heat sealing portion of another modified embodiment (i.e., the second modified embodiment). The same reference numeral will be assigned to the same element or part as the afore-mentioned thermal fusion portion 40 (see FIG. 5(*a*)), and overlapping description will be omitted.

First Modified Embodiment

While in the afore-mentioned thermal fusion portion 40 (see FIG. 5(*a*)) the end portion 42*a* of the vapor discharge portion 42 at the opening 22 side is located slightly closer to the opening 22 than the reference line L, the location of the end portion of the vapor discharge portion at the opening side may be arbitrarily modified.

Referring to FIG. 6, in the thermal fusion portion 40A the end portion 42*a* of the vapor discharge portion 42 at the opening 22 side may be disposed on the reference line L.

In accordance with this thermal fusion portion 40A, since the end portion 42*a* of the vapor discharge portion 42 at the opening 22 side is located on the reference line L, the annular portion 43 can be located as close to the opening 22 possible. Due to this, the distance P2 from the opening 22 to the annular portion 43 can be decreased. Therefore, the clearance where the content 11 may enter on the top surface of the flanged portion 30 may be made further narrow.

In other words, in the vapor discharge portion 42A and the annular portion 43 as shown in FIG. 6, the vapor discharge portion 42 is located closer to the opening 22 than the outer periphery 30*a* of the flanged portion 30, and the end portion 42*a* of the vapor discharge portion 42 at the opening 22 side is located adjacent to the opening 22. The space or interval between the opening 22 and the annular portion 43 which is formed constantly apart from the opening 22 along the circumference of the opening 22 is equal to the space or interval between the opening 22 and the end portion 42*a* of the vapor discharge portion 42.

Second Modified Embodiment

While in the afore-mentioned thermal fusion portion 40 (see FIG. 5(*a*)), the vapor discharge portion 42 is smoothly connected to the inflection portion 45, an angle between the vapor discharge portion 42 and the inflection portion 45 may be arbitrarily modified.

Referring to FIG. 7, in the thermal fusion portion 40B the vapor discharge portion 42B and the inclined portion 25B together may make a corner at the outer periphery 30*a* side of the flanged portion 320.

In this thermal fusion portion 40B the vapor discharge portion 42B and the pair of inclined portions 45B are connected and overall form M shape. In other words, each of the pair of inclined portions 45 together with a part of the vapor discharge portion 42B forms an approximately V shape, and a pair of opening portions 41B is formed at both sides of the vapor discharge portion 42B. Each of the pair of the opening portions 41B is approximately V-shaped such that it projects from the opening side toward the outer periphery 30*a* side in a plan view. Due to this a multifunctional portion 51 having both vapor discharge function and opening function can be disposed in the flanged portion 30, thereby attaining space-saving configuration.

The multifunctional portion 51 will be described in detail with reference to FIG. 7. As described previously, the multifunctional portion 51 is approximately M-shaped in the plan view. The vapor discharge portion 42B is approximately V-shaped such that it projects from the outer periphery 30*a* side toward the opening 22 side in the flanged portion 30, and the opening portion 41B is approximately V-shaped such that it projects from the opening 22 side toward the outer periphery 30*a* side of the flanged portion 30. Due to this, the end portion 42*a* of the vapor discharge portion 42B, an intersection at the opening 22 side is formed as a corner, and the end portion 42*b* of the opening portion 41B, an intersection at the outer periphery 30*a* side is formed as a corner. Both of the opening angle of the vapor discharge portion 42B and the opening angle of the opening portion 41B are made less than 90 degrees. In this case, the thermal fusion portion 40 which forms V shape of the vapor discharge portion 42B may be smoothly curved, and in even this case an opening angle of tangent lines from the end portion 42*a* as the intersection to each of both side thermal fusion portions 40 is made less than 90 degrees. Similarly, the thermal fusion portion 40 which forms V shape of the opening portion 41 may be smoothly curved, and in even this case an opening angle of tangent lines from the end portion 42*b* as the intersection to each of both side thermal fusion portions 40 is made less than 90 degrees. Furthermore, the end portion of the thermal fusion portion (45B) other than the end portion 42*a* of the thermal fusion portion 40 located at the opening 22 side, extending at the afore-mentioned opening angle from the end portion 42*b* of the opening portion 41B located at the outer periphery 30*a* side is connected to the end portion 43*a* of the annular portion 43.

Due to this, the distance from the end portion 42*b* of the opening portion 41 to the outer periphery 30*a* of the flanged portion 30 is made greater than the distance from the end portion 42*a* of the vapor discharge portion 42 to the opening 22 of the flanged portion 30. In other words, the flanged portion 30 (i.e., a boundary of the flanged portion 30) is located closer to the end portion 42*a* of the vapor discharge portion 42 than the end portion 42*b* of the opening portion 41.

Referring to FIG. 7, as the end portion 42*a* of the vapor discharge portion 42 at the opening 22 side and the end portion 43*a* (42*a*) of the opening portion 41 at the opening 22 side are formed close to the opening 22, the annular portion 43 connected to the end portion 43*a* of the opening portion 41 is located close to the opening 22.

As the vapor discharge portion 42B are connected to the inflection portion 45B forming a corner in the multifunctional portion 51, the depth d2 relatively increases. Such a multifunctional portion 51 having increased depth d2 is preferably disposed in a relatively enlarged area of the flanged portion 30.

Referring to FIG. 8, a container 20C is provided with the multifunctional portion 51, which has both vapor discharge function and opening function and is located in the grasping portion 32, a second enlarged portion of the flanged portion 30. In FIG. 8, each of a pair of grasping portions 32 is provided with the multifunctional portion 51 in light of reliability of attaining vapor discharge function and opening function of the multifunctional portion 51. However, the present invention is not limited to the above embodiment. For example, the multifunctional portion 51 may be formed in either one of the grasping portions 32. Furthermore, as shown in FIG. 7, the end portion 42*a* of the vapor discharge portion 42B at the opening 22 side is located on the reference line L, thereby allowing the annular portion 43 to be located as close to the opening 22 possible. As such, the multifunctional portion 51 having both vapor discharge function and the opening function is integrated into the grasping portion 32, thereby rendering the width W1 of the other portion (i.e., the first enlarged portion) of the flanged portion 30 much narrower. As a result, more compact container 20C can be obtained.

Referring to FIG. 9(*a*), in a case where the appearance or contour of the container 20D is a cornered type (e.g., a rectangular shape), a corner portion 52 of the flanged portion 30 may be provided with a portion (i.e., a second enlarged portion) wider than the portion (i.e., the first enlarged portion) other than the corner portion 52. As shown in FIG. 9(*b*) which is an enlarged drawing of section P encircled by chain line in FIG. 9(*a*), the multifunctional portion 51 having both the vapor discharge function and the opening function may be formed in the corner portion 52, as the second enlarged portion, of the flanged portion 30. Even in this embodiment as shown in FIG. 9(*a*) and FIG. 9(*b*), the multifunctional portion 51 may be only disposed in one corner portion 52 out of multiple corner portions 52 in light of reliability of attaining the vapor discharge function and the opening function of the multifunctional portion 51. However, the present invention is not limited to the above embodiment. The multifunctional portion 51 may be formed in other corner portion 52. As such, the multifunctional portion 51 having the vapor discharge function and the opening function is integrated into the corner portion 52, thereby rendering the width W2 of the other portion (i.e., the first enlarged portion) of the flanged portion 30 much narrower. As a result, more compact container 20D can be obtained.

Furthermore, referring to FIG. 9(*a*) and FIG. 9(*b*), the annular portion 43 of the thermal fusion portion 40B formed along the reference line L is located at a position less than 50% of the width of the flanged portion 30 from the opening 22. However, the present invention is not limited to the above embodiment. As shown in FIG. 7, the end portion 42*a* of the vapor discharge portion 42B at the opening 22 side is arranged on the reference line L, thereby allowing the annular portion 43 to be located as close to the opening 22.

(Another Configuration of the Container)

Figure 10:
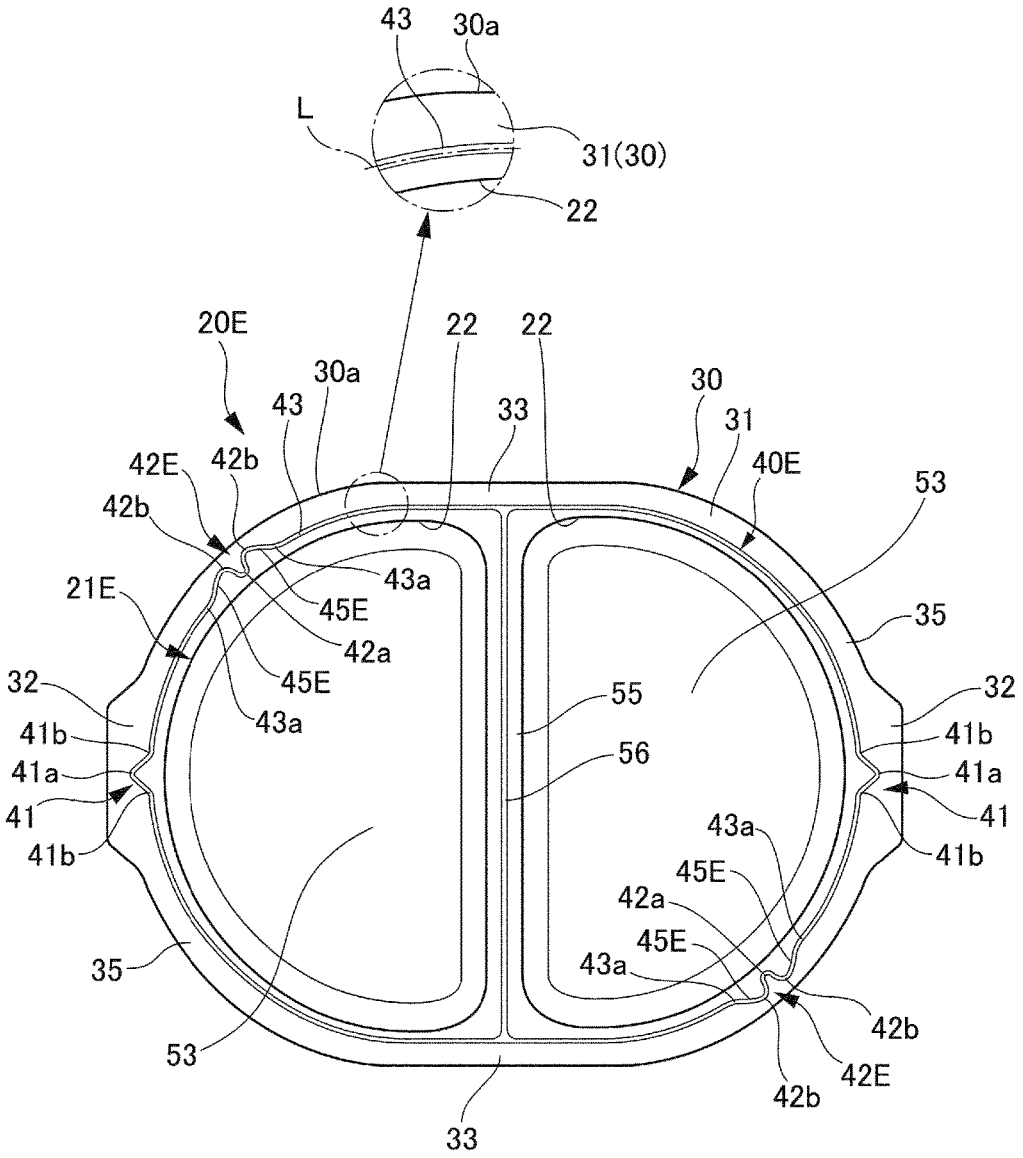
FIG. 10 is a plan view of another embodiment of a container for microwave oven.

Next, another configuration of the container will be described in detail with reference to FIG. 10. FIG. 10 is a plan view of another configuration of the container. In this regard, the same reference numeral will be assigned to the same element or part of the afore-mentioned container 20 (see FIG. 4), and overlapping description will be thus omitted.

While the afore-mentioned container 20 (see FIG. 4) employs the main body 21 having one receiving portion for receiving the content 11 therein, the main body of the container as used in the specification may have a plurality of receiving portions.

Referring to FIG. 10, the container 20E has two receiving portions 53, which are disposed in the main body 21E. The two receiving portions 53 are defined by a partition wall 55. On the top surface (i.e., an upper surface) of the partition wall 55 is provide with a connecting portion 56 connecting the opposed portions of the annular portion 43 to each other. The lid material (not shown) is thermally fused to the thermal fusion portion 40E including the connecting portion 56, thereby allowing the two receiving portions 53 to be respectively sealed. A flanged portion 30 is formed in the main body 21E such that it surrounds the openings 22 of the two receiving portions 53. A pair of second enlarged portions as the grasping portions 32 is opposed to each other and disposed in the flanged portion 30. One of the second enlarged portions is disposed at one receiving portion 53 side, and the other of the second enlarged portions is disposed at the other receiving portion 53 side.

Furthermore, the thermal fusion portion 40E is provided with the multifunctional portion 51 having both vapor discharge function and opening function and located on each grasping portion 32. Due to this, each receiving portion 53 is provided with one multifunctional portion 51. As described previously, in a plan view, the multifunctional portion 51 is provided with a vapor discharge portion 42E which is approximately V-shaped such that it projects from the outer periphery 30*a* side toward the opening 22 side, and the opening portion 41 which is disposed at both sides of the vapor discharge portion 42E and approximately V-shaped such that it projects from the opening 22 side toward the outer periphery 30*a* side.

In accordance with such a container 20E, due to the two vapor discharge portions 42E vapor is automatically discharged from each of the receiving portions 53. Furthermore, the annular portion 43 can be located close to the opening 22 of the main body 21E. Even in this case, the multifunctional portion 51 as shown in FIG. 7 can be employed, and the annular portion 43 can be located as close to the opening 22 possible.

Figure 11:
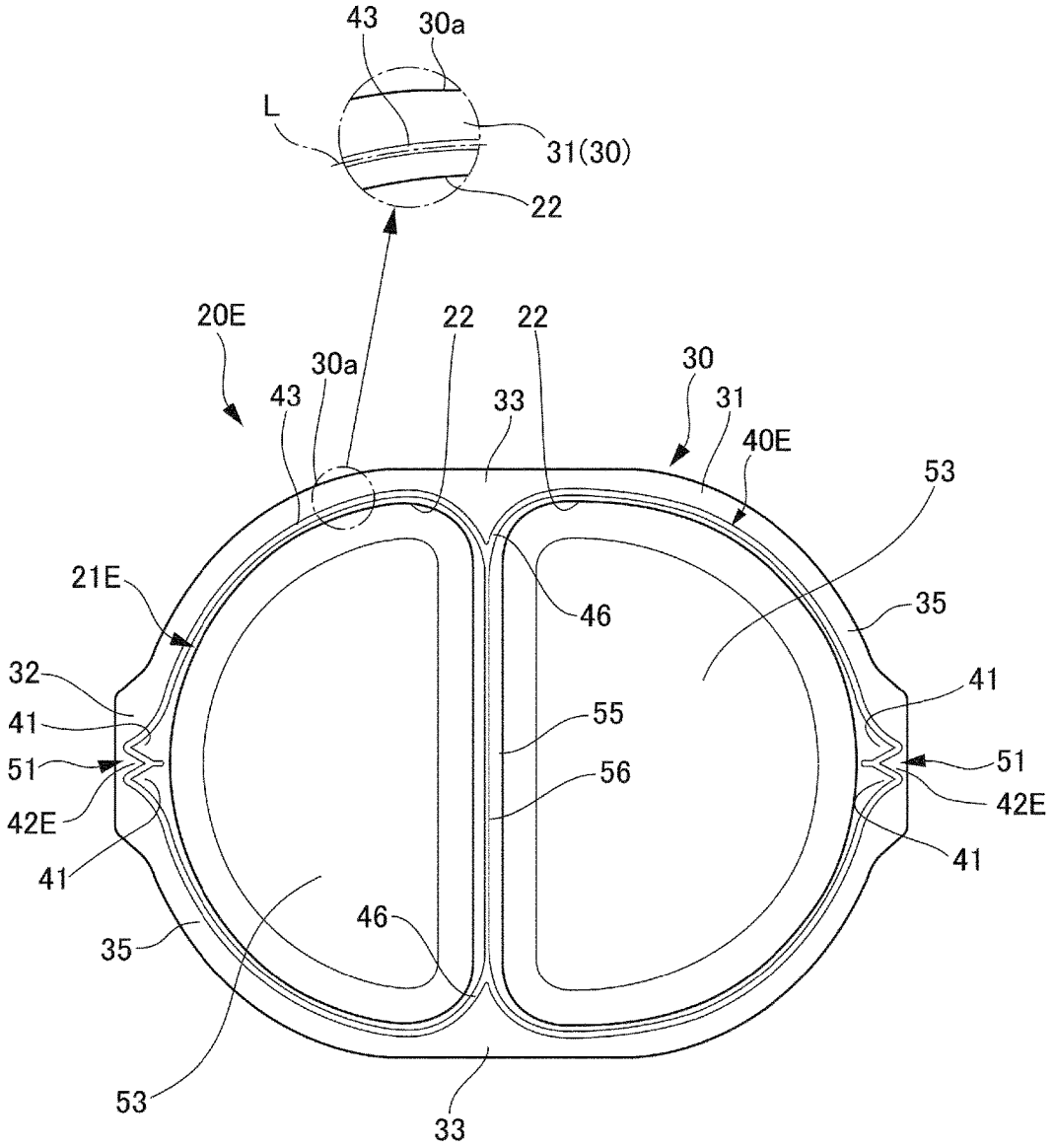
FIG. 11 is a plan view of a further another embodiment of a container for microwave oven.

Referring to FIG. 11, the grasping portions 32 corresponding to the pair of enlarged portions may be located in the flanged portion 30 such that one of them is disposed at one receiving portion 53 and the other of them is disposed at the other receiving portion 53. In this configuration, the two grasping portions 32 are opposed to each other. The multifunctional portion 51 having vapor discharge function and opening function may be formed on each of the grasping portions 32. As mentioned previously, in the plan view, the multifunctional portion 51 is provided with a vapor discharge portion 42E that is approximately V-shaped such that it projects from the outer periphery 30*a* side toward the opening 22 side, and an opening portion 41 that is disposed at both sides of the vapor discharge portion 42E and is approximately V-shaped such that it projects from the opening 22 side toward the outer periphery 30*a* side. As a result, the multifunctional portion 51 is approximately M-shaped as a whole. Furthermore, a boundary portion 46 of the annular portion 43 corresponding to the two receiving portions 53 can be formed in a shape of narrow or constricted sealing in conformity with the opening shape of the two receiving portions 53.

While a preferred embodiment of the present invention has been shown and described with particularity, it will be appreciated that various changes and modifications may suggest themselves to one having ordinary skill in the art upon being apprised of the present invention. It is also intended to encompass all such changes and modifications as fall within the scope and spirit of the appended claims.

REFERENCE SIGNS LIST

10 package (package for microwave oven)
11 content
12 lid material
20 container (container for microwave oven)
20C container (container for microwave oven)
20D container (container for microwave oven)
20E container (container for microwave oven)
21 main body (of container)
21E main body (of container)
22 opening
30 flanged portion
30*a* outer periphery
31 base portion (a first enlarged portion)
32 grasping portion (a second enlarged portion)
40 thermal fusion portion
40A thermal fusion portion
40B thermal fusion portion
40E thermal fusion portion
41 opening portion
41B opening portion
42*a* end portion located at the opening side
42*b* a pair of end portions located at the outer periphery side
42A vapor discharge portion
42B vapor discharge portion
42E vapor discharge portion
43 annular portion
43*a* end portion
45 inclined portion
45B inclined portion
45E inclined portion
51 multifunctional portion
52 corner portion (a second enlarged portion)
46 boundary portion
53 receiving portion
55 partition wall
L reference line
W width of flanged portion

The invention claimed is:

1. A container for a microwave oven, comprising:

a concave main body configured to receive a content therein and having an opening, an annularly flanged portion formed at the opening in an upper end of the concave main body, and a rib-shaped thermal fusion portion formed over a whole circumference of a top surface of the flanged portion to be thermally fused to a film-shaped lid material for closing the opening, wherein the thermal fusion portion is provided with first and second opening portions that are each approximately V-shaped such that each opening portion projects from the opening side toward an outer periphery of the flanged portion in a plan view;

a vapor discharge portion that is approximately V-shaped such that it projects from the outer periphery side toward the opening side in a plan view; and an annular portion formed along an annular reference line, which is similar to a shape of an inner periphery of the opening, except for the opening portions and the vapor discharge portion, wherein a pair of end portions of the vapor discharge portion located at the outer periphery side is located closer to the outer periphery than the reference line in an across-the-width direction of the flanged portion, and connected through a pair of inclined portions to an end portion of the annular portion located at both sides of the vapor discharged portion;

wherein the annular portion is disposed at locations less than 50% of a width of the flanged portion from the opening;

wherein each of the pair of the inclined portions together with a part of the vapor discharge portion forms an approximately V-shape;

wherein the flanged portion has a first enlarged portion and a second enlarged portion which is wider than the first enlarged portion;

wherein, in the first or second enlarged portion, the first and second opening portions are formed adjacent to first and second sides, respectively, of the vapor discharge portion, the vapor discharge portion being formed in the same enlarged portion as the first and second opening portions; and wherein, in the first or second enlarged portion, grasping portions, which a user can grasp, are formed on outer sides of the first and second opening portions, the outer sides being opposite to the vapor discharge portion.

2. The container for the microwave oven according to claim 1, wherein the vapor discharge portion at the pair of end portions is disposed at location of 50% or above of the width of the flanged portion from the opening.

3. The container for the microwave oven according to claim 1, wherein the vapor discharge portion at the end portion located at the opening side is disposed at location which the reference line passes.

4. The container for the microwave oven according to claim 1, wherein the annular portion lies between the opening portion and the vapor discharge portion.

5. The container for the microwave oven according to claim 1, wherein the main body has an approximately circular or oval shape at the opening, and wherein the second enlarged portion is formed as a grasping portion.

6. The container for the microwave oven according to claim 1, wherein the main body has an approximately rectangular shape at the opening, and wherein the second enlarged portion is formed as a corner portion.

7. The container for the microwave oven according to claim 1, wherein the annular portion is located close to the opening.

8. The container for the microwave oven according to claim 1, wherein the main body has a plurality of receiving portions configured to receive the content therein, and wherein a plurality of the vapor discharge portions is formed corresponding to the plurality of receiving portions.

9. The container for the microwave oven according to claim 8, wherein the concave main body comprises a partition wall defining adjacent receiving portions, and wherein the thermal fusion portion further comprises a connecting portion which is provided on the top of the partition wall and which connects opposite portions of the annular portion such that each adjacent receiving portion is able to be sealed.

10. The container for the microwave oven according to claim 9, wherein the plurality of receiving portions is defined by two receiving portions, the flanged portion comprises two grasping portions situated opposite to each other with the two receiving portions situated between the grasping portions, and each receiving portion is provided with a multifunctional portion situated in the grasping portion.

11. The container for the microwave oven according to claim 10, wherein the annular portion has boundary portions which are connected to the connecting portion and the boundary portions branch off so as to closely follow along the opening of each receiving portion.

12. The container for the microwave oven according to claim 9, wherein each opening of the two receiving portions has a substantially semicircular shape or substantially semielliptical shape in a plan view.

13. The container for the microwave oven according to claim 1, wherein inflection points are formed between the annular portion and the inclined portions in a plan view.

14. The container for the microwave oven according to claim 13, wherein the inflection points are disposed at locations less than 50% of a width of the flanged portion from the opening.

15. The container for the microwave oven according to claim 1, wherein an opening angle formed between the opening portion and the vapor discharge portion is less than 90 degrees.

16. The container for the microwave oven according to claim 1, wherein an angle formed by the vapor discharge portion is less than 90 degrees.

17. The container for the microwave oven according to claim 1, wherein the first opening portion is connected directly through a first inflection portion to a first end portion of the annular portion and the second opening portion is connected directly through a second inflection portion to a second end portion of the annular portion.

18. A package for a microwave oven by which a content is hermetically sealed and stored, comprising a film-shaped lid material, and a container for the microwave oven hermetically sealed by the film-shaped lid material, the container for the microwave oven comprising:

a concave main body configured to receive a content therein and having an opening, an annularly flanged portion formed at the opening in an upper end of the concave main body, and a rib-shaped thermal fusion portion formed over a whole circumference of a top surface of the flanged portion to be thermally fused to a film-shaped lid material for closing the opening, wherein the thermal fusion portion is provided with first and second opening portions that are each approximately V-shaped such that each opening portion projects from the opening side toward an outer periphery of the flanged portion in a plan view;

a vapor discharge portion that is approximately V-shaped such that it projects from the outer periphery side toward the opening side in a plan view; and an annular portion formed along an annular reference line, which is similar to a shape of an inner periphery of the opening, except for the opening portions and the vapor discharge portion, wherein a pair of end portions of the vapor discharge portion located at the outer periphery side is located closer to the outer periphery than the reference line in an across-the-width direction of the flanged portion, and connected through a pair of inclined portions to an end portion of the annular portion located at both sides of the vapor discharged portion;

wherein the annular portion is disposed at locations less than 50% of a width of the flanged portion from the opening;

wherein each of the pair of the inclined portions together with a part of the vapor discharge portion forms an approximately V-shape;

wherein the flanged portion has a first enlarged portion and a second enlarged portion which is wider than the first enlarged portion;

wherein, in the first or second enlarged portion, the first and second opening portions are formed adjacent to first and second sides, respectively, of the vapor discharge portion, the vapor discharge portion being formed in the same enlarged portion as the first and second opening portions; and wherein, in the first or second enlarged portion, grasping portions, which a user can grasp, are formed on outer sides of the first and second opening portions, the outer sides being opposite to the vapor discharge portion.

* * * * *